United States Patent [19]

Ajamian

[11] Patent Number: 4,677,963

[45] Date of Patent: Jul. 7, 1987

[54] ANNULAR CUTTING DISC

[76] Inventor: Hrant K. Ajamian, 30087 Cartier Dr., Rancho Palos Verdes, Calif. 90274

[21] Appl. No.: 671,175

[22] Filed: Nov. 14, 1984

[51] Int. Cl.[4] ..... B28D 1/04

[52] U.S. Cl. ..... 125/15; 51/206 R

[58] Field of Search ..... 51/206 R; 125/15, 11 DF

[56] References Cited

U.S. PATENT DOCUMENTS

| | | | |
|---|---|---|---|
| 3,092,094 | 6/1963 | Griffin | 125/15 |
| 3,127,887 | 4/1964 | Metzger | 125/15 |
| 3,205,624 | 9/1965 | Weiss | 125/15 |
| 3,626,921 | 12/1971 | Lane | 51/206 R |
| 3,822,689 | 7/1974 | Oshima | 125/11 DF |

FOREIGN PATENT DOCUMENTS

| | | | |
|---|---|---|---|
| 76793 | 6/1977 | Japan | 125/11 DF |

*Primary Examiner*—Harold D. Whitehead
*Attorney, Agent, or Firm*—Don B. Finkelstein

[57] ABSTRACT

An improved annular cutting disc of the type having an inner annular edge as the cutting edge. The disc is comprised of a thin, metallic core member and a first coating of nickel is plated on the inner annular edge of the core member. A second coating, of a slurry of nickel and diamond particles is on the first coating and extends radially inwardly toward the axis of the annular cutting disc, to provide the cutting surface.

11 Claims, 4 Drawing Figures

ANNULAR CUTTING DISC

BACKGROUND OF THE INVENTION

1. Field of the Invention

This invention relates to the cutting art, and, more particularly, to an improved annular cutting disc.

2. Description of the Prior Art

In many applications, an annular disc is utilized as a cutting tool. In such applications, the disc is generally a flat, comparatively thin, metallic core which has an outer edge having attachment means for attachment to a rotary motion producing device. An inner annular edge is provided in the core member, and the inner annular edge is the cutting edge.

With the increased activities in the semi-conductor field, wherein crystals of comparatively high unit cost must be precisely cut, such annular cutting discs have been utilized. In order to provide the cutting edge, the prior art annular cutting discs had a coating of a slurry of a nickel matrix with diamond particles therein plated on the cutting edge to provide the actual cutting surface. The diamond particles in the nickel matrix were generally in the range of, for example, 30 to 80 microns.

Materials associated with the semi-conductor industry, such as galium arsenide, silicon, and the like, are comparatively high cost. Consequently, it is desired to minimize the amount of waste material made during the cut of such structures. It is, therefore, desired to make as thin a cut as possible. Additionally, it is necessary that the edges of the material being cut be as planar and free from surface irregularities as possible, because of the precision required in such structures after they are cut.

While the above described configuration has, at times, provided a satisfactory cutting of such materials as galium arsenide, or silicon, or the like, as utilized in the semi-conductor industry, in general, it has been found that when the core is made thinner in order to minimize the loss of the material being cut, precision of the cut was not maintained, due to wobble and/or bowing of the core member during the cutting operation. Additionally, even though the side edges of the coating of the diamond/nickel slurry were ground, it has been found that in areas closely adjacent the core, grinding could not provide the smooth exterior finish required. That is, often there would be one or more diamond particles loosely, or only partially retained by the nickel matrix, and extending therefrom. Such particles could not be ground away, due to the risk of damaging the core during the grinding operation. Therefore, such diamond particles tended to either break loose or to cause an uneven or "ridged" cut in the material being cut, and such cuts or ridges could be in the range of 30 microns deep. Such ridges or cuts tended to degrade the performance of the galium arsenide, silicon, or the like, when it was ultimately utilized in various semi-conductor devices. The bowing or wobbling of the blade not only caused excessive waste during the cut, but also, depending upon the exact motion of the blade, could cause convex or concave edges to the material being cut.

Accordingly, there has long been a need for an annular cutting disc which could provide a comparatively narrow and flat sided cut in semi-conductor materials, such as galium arsenide, silicon, or the like. However, the invention herein is not limited to the application of an annular cutting disc to such materials: rather, it can be advantageously utilized in a plurality of applications.

SUMMARY OF THE INVENTION

It is, therefore, an object of the present invention to provide an improved annular cutting disc.

It is another object of the present invention to provide an improved annular cutting disc that is comparatively thin in dimension to minimize lost material during the cut.

It is another object of the present invention to provide an annular cutting disc that has a comparatively long operational life and which may be fabricated comparatively economically to provide a very narrow cut having substantially flat sides.

The above and other objects of the present invention are achieved, according to a preferred embodiment thereof, by providing an annular cutting disc comprised of a metallic annular core member. The annular core member has an outer wall defining a predetermined outer perimeter which, for example, may be circular about a central axis. The annular core member also has an inner wall defining a predetermined inner perimeter, which, for example, may also be circular, and concentric about the central axis with the outer edge. The inner wall has regions immediately adjacent thereto defining a cutting portion of the annular core member.

A first coating is placed, for example, by plating, on the annular core member in regions adjacent the inner wall and extending along the opposed sides of the annular core member in a radially outward direction from the inner wall toward the outer wall thereof. The first coating also extends radially inwardly from the inner wall toward the central axis a preselected distance. The first coating is, according to the principles of the present invention, pure nickel, that is, nickel that is free or substantially free from diamond particles.

A second coating is applied to the radially inward edge of the first coating and the second coating extends radially inwardly toward the central axis therefrom. The second coating is a slurry mixture of nickel and the diamond particles. The radially extending edges of both the first and second coatings may, if desired, be conveniently ground to a co-planar condition, and, since there are no diamond particles in the first coating, a smooth finish to such surfaces may be obtained without damage to the core. The innermost edge of the second coating, which defines the cutting edge of the annular cutting disc may also be "dressed" or ground to provide a flat surface.

It has been found that the smooth surfaces of both the first and second coating tend to prevent any ridging or grooving in the material being cut, and further, the core member, which, for example, may be of corrosion resistant steel, as well as the first and second coating, may be made comparatively thinner, thereby reducing waste material during the cut.

BRIEF DESCRIPTION OF THE DRAWING

The above and other embodiments of the present invention may be more fully understood from the following detailed description, taken together with the accompanying drawing, wherein similar reference characters refer to similar elements throughout, and in which.

DESCRIPTION OF THE PREFERRED EMBODIMENTS

Figure 1:
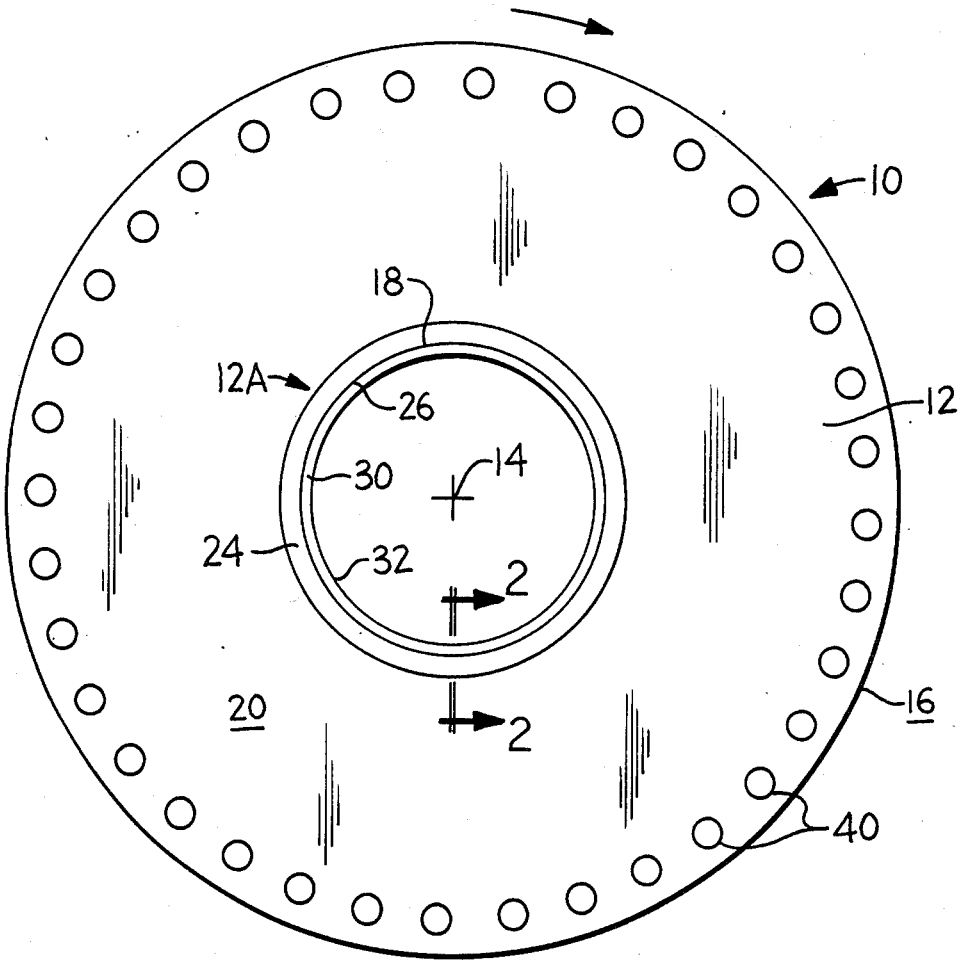
FIG. 1 is a plan view of an annular cutting disc according to the principles of the present invention.
Figure 2:
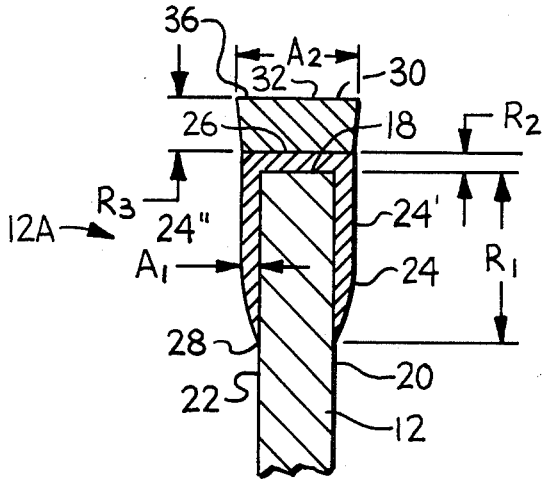
FIG. 2 is a sectional view along the line 2—2 of FIG. 1.

Referring now to the drawing, there is illustrated in FIGS. 1 and 2 a preferred embodiment, generally designated 10, of the present invention of an improved annular cutting disc arrangement. The annular cutting disc arrangement 10 generally comprises an annular core member 12, which, in preferred embodiments, is metallic and preferably corrosion resistant steel. The metallic core member 12 has a central axis 14 and an outer wall 16 defining a predetermined outer perimeter, which, for example, is circular about the central axis 14. The annular core member 12 also has an inner wall 18 defining a predetermined inner perimeter which may be circular and concentric with the outer wall 16 about the central axis 14. The core member 12 also has a pair of opposed surfaces 20 and 22, extending between the outer wall 16 and the inner wall 18, and a predetermined thickness, indicated in FIG. 2 by the letter "T" between the opposed surfaces 20 and 22. The thickness "T" of the annular core member 12 is, preferably, as thin as consistent with providing a satisfactory cutting disc, and, for example, may be on the order of 0.002 inches to 0.008 inches, although other dimensions may be utilized. The region of the core member 12 adjacent the inner wall 18 is a cutting portion 12A thereof.

The diameter of the outer wall 16 may be on the order of 22 inches, and the diameter of the inner wall 18 may be on the order of 8 inches, although larger or smaller dimensions may be utilized as required for particular applications.

A first coating, generally designated 24, is applied, for example, by plating, on the opposed surfaces 20 and 22, as well as the inner wall 10 of the core member 12 in the cutting portion 12A thereof, and the first coating extends radially outwardly from the inner wall 18 toward the outer wall 16 a first preselected distance indicated by "$R_1$" on FIG. 2, which, for example, may be on the order of 0.001 inches to 4.0 inches, although other dimensions may be utilized in particular applications. The first coating 24 also extends radially inwardly from the inner wall 18 toward the central axis 14 a second preselected distance indicated in FIG. 2 by "$R_2$," which may be on the order of 0.001 inches to 0.005 inches, to define an inner first coating edge 26. In some applications, however, it has been found that the entire portion of the first coating 24 extending radially inwardly from inner wall 18 of the core 12 may be eliminated, thus reducing "$R_2$" to 0.

The first coating 24 also has a first preselected axial thickness on each of the pair of opposed surfaces 20 and 22 of the core member 12, as indicated in FIG. 2 at "$A_1$." Generally, the first preselected axial thickness "$A_1$" on both the opposed surfaces 20 and 22 is in the range of 0.00005 inches to 0.010 inches, although other dimensions may be utilized. The first coating 24 is generally applied by plating and, consequently, has a slightly tapered condition as it approaches the radially outward end thereof, indicated at 28. The first coating 24, according to the principles of a preferred embodiment, is nickel, deposited, as noted above, by plating, on the core member 12 in the cutting portion 12A thereof.

A second coating, generally designated 30, is applied on the inner first coating edge 26, and extends radially inwardly toward the central axis 14 a third preselected distance indicated by "$R_3$," which may be on the order of 0.001 inches to 0.025 inches, on FIG. 2, to define a cutting edge 32, although other dimensions may be utilized. The second coating also has a second preselected axial thickness indicated by "$A_2$" on FIG. 2, and has a pair of radially extending surfaces 34 and 36, extending between the plane containing the first inner coating edge 26 and the cutting edge 32. The second coating 30, is a slurry mixture of diamond particles in a nickel matrix and is deposited by, preferably, plating. The size of the diamond particles is, in general, on the order of 30 to 80 microns, although other size diamond particles may be utilized as desired. In those embodiments of the present invention wherein the dimensions "$R_2$" is 0, so that the first inner coating edge 26 is coincident with the inner wall 18 of the core member 12, the second coating 30 is applied directly thereto.

In many applications, the axial thickness of the second coating 30 at the cutting edge 32 is greater than the axial thickness of the second coating 30 at the inner first coating edge 26 to provide a slightly tapered configuration.

The first coating 24 has outer radially extending surfaces 24' and 24'', extending from the inner first coating edge 26 to the radially outward end 28 thereof. In some preferred embodiments of the present invention, the radially extending surfaces 36 and 24'', and 34 and 24', may be ground to a co-planar configuration. In other embodiments, the respective radially extending outer surfaces of the first and second coatings may be non con-planar. The second preselected axial thickness "$A_2$" of the second coating 30 at the inner first coating edge 26 is in the range of 0.005 inch to 0.075 inches, although greater or lesser dimensions may be utilized as required for particular applications. The radial distance "$R_3$," between the cutting edge 32 and the inner first coating edge 26 may, as noted above, be in the range of 0.001 inches to 0.025 inches, although greater or lesser dimensions may be utilized as desired for particular applications. As noted above, the second coating may be tapered and, therefore, the second preselected axial thickness "$A_2$" at the cutting edge 30, may be on the order of 0.001 inches to 0.004 inches greater than at the inner first coating edge 26, although other dimensions may be utilized.

In order to mount the annular cutting disc 10, mounting means, such as walls defining a plurality of apertures 40 in regions adjacent the outer wall 16 may be provided. The cutting disc may be mounted by means of the apertures 40 in a rotation producing structure (not shown) to rotate the core 12 in, for example, the direction indicated by the arrow 42 about the central axis 14.

Since the second coating 26 is spaced from the core member 12, or has an inner edge coincident with the inner wall 18, the radially extending surfaces 34 and 36 may be ground, as noted above, to a planar configuration, and to remove any comparatively loose or only partially held diamond particles therefrom, without damage to the core member 12.

Figure 3:
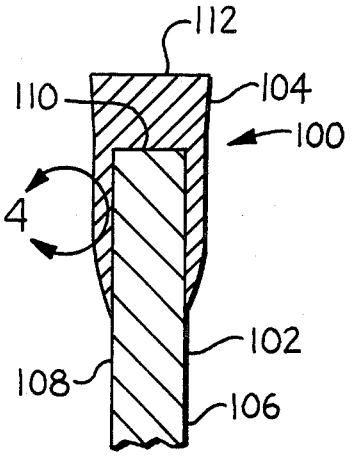
FIG. 3 (PRIOR ART)
FIG. 3 is a sectional view illustrating prior art annular cutting disc construction.
Figure 4:
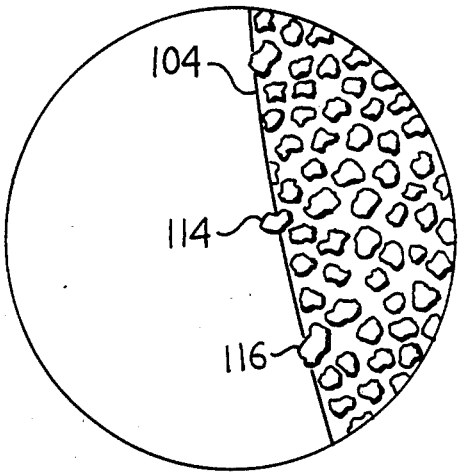
FIG. 4 (PRIOR ART)
FIG. 4 is an enlarged view of the portion designated "FIG. 4" on FIG. 3.

The advantages of the present invention, as illustrated in the embodiment 10 described above in connection with FIGS. 1 and 2, may be appreciated by comparison thereof with the structure heretofore utilized in similar applications. FIGS. 3 and 4 illustrate a prior art annular cutting disc, generally designated 100. FIG. 3 is a sectional view of such a prior art annular cutting disc, similar to the sectional view of FIG. 2 of Applicant's improved annular cutting disc described above. FIG. 4 is an enlarged view of a portion of the prior art annular cutting disc of FIG. 3. The annular cutting disc 100, comprises an annular core member 102, upon which there is deposited, in regions adjacent the inner wall 116, for example, by plating, a coating 104, which is a slurry mixture of diamond particles in a nickel matrix. As can be seen, this coating 104 extends along the outer surfaces 106 and 108 of the core member 102, and also extends radially inwardly from the inner wall 110 of the core member 102. While the cutting edge 112, of the coating 104 may be properly dressed or ground, it has been found that in regions of the coating 104 adjacent the core 102, grinding cannot provide the type of smooth finish thereon which is desired. This is because grinding in the area adjacent the core 102 tends to weaken or distort the core member 102. Such weakening and/or distortion thereof results in a cut which is wider than desired, due to bowing or wobble of the core member 102, thereby increasing waste material, in waves or grooves in the edges which are cut, and often, a cut not exactly along the desired cut line. One of the significant problems of such prior art annular cutting discs, as illustrated in FIGS. 3 and 4, is the outer surface of the coating 104 in regions adjacent the core member 102. FIG. 4 is an enlarged view of a portion of the outer edge of the coating 104 in regions adjacent the core member 102. As shown in FIG. 4, diamond particles, which are in the matrix of nickel in the coating 104 may be only partially retained, as illustrated at 114 and 116. Since such surfaces cannot be effectively ground to provide the desired smooth finish, such diamond particles as 114 and 116, which may be, for example, on the order of 30 to 80 microns or so in size, are only partially held by the matrix of nickel and project outwardly from the surface. During cutting operation, such diamond particles as 114 and 116 can produce grooves or waviness in the cut surface, may tend to distort the cutting blade during the cutting operation, inducing wobble to the cutting disc, and/or cutting along a cut line other than the desired line, and the like. Additionally, such diamond particles as 114 and 116 tended to break loose from the matrix of nickel and could cause a groove in the cut surface, for example, up to 30 or 35 microns deep. These disadvantages, which resulted from the use of the prior art cutting disc 100 are obviated by the embodiment 10 of the present invention, as described above in connection with FIGS. 1 and 2.

From the above, it is apparent that the invention herein provides an improved annular cutting disc which can provide a minimum of waste material and result in a more precise cut, with smoother cut surfaces in the material being cut. Those skilled in the art may find many variations and adaptations of the invention herein, and the appended claims are intended to cover all such variations and adaptations falling within the true scope and spirit of the invention.

What is claimed is:

1. An improved anular cutting disc comprising, in combination:

a metallic annular core member having:

(A) a central axis;

(B) an outer wall defining a predetermined outer perimeter;

(C) an inner wall defining a predetermined inner perimeter;

(D) a pair of opposed surfaces extending between said core member in regions adjacent said cutting portion thereof, and extending radially outwardly from said inner wall a first preselected distance toward said outer wall, and having an inner first coating edge spaced from said central axis, and said first coating having a first preselected axial thickness on each of said pair of opposed surfaces of said core member to define outer surfaces of said first coating;

a second coating on said inner first coating edge and extending radially inwardly toward said central axis a third preselected distance to define a cutting edge, and said second coating having a second preselected axial thickness and having a pair of oposed radially extending surfaces between said inner first coating edge and said cutting edge, said second preselected axial thickness of said second coating is greater at said cutting edge than at said inner first coating edge;

said first coating is, substantially free of diamond particles;

said second coating is a slurry of diamond particles in a matrix; and said pair of opposed radially extending surfaces of said second coating are substantially free of loosely held diamond particles.

2. The arrangement defined in claim 1, wherein:

said outer perimeter and said inner perimeter are circular, said second preselected axial thickness of said second coating is greater at said cutting edge than at said inner first coating edge.

3. The arrangement defined in claim 2, wherein:

said core is fabricated from corrosion resistant steel;

said first coating is nickel; and said second coating is a slurry of diamond particles in a nickel matrix.

4. The arrangement defined in claim 3, wherein:

said outer surfaces of said first coating are ground; and said pair of oposed radially extending surfaces of said second coating are ground and are substantially co-planar with said outer surface of said first coating.

5. The arrangement defined in claim 4, wherein:

said second preselected axial thickness of said second coating at said inner first coating edge is in the range of 0.005 inch to 0.025 inches; and the radial distance between said cutting edge and the outer end of said first coating is in the range of 0.001 inch to 0.025 inches.

6. The arrangement defined in claim 5, wherein:

said second preselected axial thickness of said second coating, at said cutting edge, is on the order of 0.001 inches to 0.004 inches greated than at said inner first coating edge.

7. The arrangement defined in claim 6, wherein:

said outer diameter of said annular core member is on the order of 22 inches;

said cutting edge of said second coating has a diameter on the order of 8 inches; and said diamond particles in said second coating have a size on the order of 45 microns.

8. The arrangement defined in claim 7, and further comprising:

attachment means on said core member for mounting said core member in a rotary motion producing means for rotation about said central axis.

9. An improved annular cutting disc comprising, in combination:

a metallic annular core member having:

(A) a central axis;

(B) an outer wall defining a predetermined outer perimeter;

(C) an inner wall defining a predetermined inner perimeter;

(D) a pair of opposed surfaces extending between said outer wall and said inner wall;

(E) a predetermined thickness between said pair of opposed surfaces, and said outer wall and said inner wall concentric to said central axis; and (F) said inner wall defining a cutting portion of said core member;

a first coating substantially free of diamond particles on said pair of opposed surfaces of said core member in regions adjacent said cutting portion thereof, and extending radially outwardly from said inner wall a first preselected distance toward said outer wall, and having an inner first coating edge spaced from said central axis, and said first coating having a first preselected axial thickness on each of said pair of opposed surfaces of said core member to define outer surfaces of said first coating;

a second coating comprising a slurry of diamonds partially in a metallic matrix, on said inner first coating edge and extending radially inwardly toward said central axis a third preselected distance to define a cutting edge, and said second coating have a second preselected axial thickness and having a pair of oposed radially extending surfaces between said inner first coating edge and said cutting edge, and said pair of opposed radially extending surfaces are substantially free of loosely held diamond particles; and said inner first coating edge of said first coating and said inner wall of said core member are co-planar.

10. The arrangement defined in claim 9, wherein:

said outer perimeter and said inner perimeter are circular; and said second preselected axial thickness of said second coating is greater at said cutting edge than at said inner first coating edge.

11. The arrangement defined in claim 9, wherein:

said core is fabricated from corrosion resistant steel;

said first coating is nickel, substantially free of diamond particles; and said second coating is a slurry of diamond particles in a nickel matrix.

* * * * *